US011352114B2

(12) United States Patent
Osara et al.

(10) Patent No.: US 11,352,114 B2
(45) Date of Patent: Jun. 7, 2022

(54) SHIP PROPULSION SYSTEM AND SHIP

(71) Applicant: Yanmar Power Technology Co., Ltd., Osaka (JP)

(72) Inventors: Tatsuro Osara, Osaka (JP); Hisanori Mori, Osaka (JP)

(73) Assignee: Yanmar Power Technology Co., Ltd., Osaka (JP)

( * ) Notice: Subject to any disclaimer, the term of this patent is extended or adjusted under 35 U.S.C. 154(b) by 24 days.

(21) Appl. No.: 17/055,567

(22) PCT Filed: May 15, 2019

(86) PCT No.: PCT/JP2019/019244

§ 371 (c)(1),
(2) Date: Nov. 14, 2020

(87) PCT Pub. No.: WO2019/221162

PCT Pub. Date: Nov. 21, 2019

(65) Prior Publication Data

US 2021/0139123 A1 May 13, 2021

(30) Foreign Application Priority Data

May 16, 2018 (JP) ..... JP2018-094203

(51) Int. Cl.

| | |
|---|---|
| ***B63H 20/14*** | (2006.01) |
| ***B63H 20/12*** | (2006.01) |
| ***B63H 21/14*** | (2006.01) |
| ***B63H 21/17*** | (2006.01) |
| ***B63H 21/20*** | (2006.01) |
| ***B63H 25/42*** | (2006.01) |

(52) U.S. Cl.
CPC ..... *B63H 20/14* (2013.01); *B63H 20/12* (2013.01); *B63H 21/14* (2013.01); *B63H 21/17* (2013.01); *B63H 21/20* (2013.01); *B63H 25/42* (2013.01)

(58) Field of Classification Search
CPC ..... B63H 20/14; B63H 20/12; B63H 21/14; B63H 21/17; B63H 21/20; B63H 25/42
See application file for complete search history.

(56) References Cited

FOREIGN PATENT DOCUMENTS

| | | | |
|---|---|---|---|
| JP | 2007191138 A | * | 8/2007 |
| JP | 2010173447 A | * | 8/2010 |
| JP | 2013241112 A | * | 12/2013 |
| JP | 2014148272 A | * | 8/2014 |
| JP | 2014148273 A | * | 8/2014 |

* cited by examiner

*Primary Examiner* — Stephen P Avila
(74) *Attorney, Agent, or Firm* — Chris Mizumoto

(57) ABSTRACT

A ship propulsion system provides a first power transmission device that transmits power from an internal combustion engine to a propeller, a second power transmission device that transmits power from an electric motor to a propeller and that is mounted to the hull so as to be able to turn up and down independently from the first power transmission device, an actuator for causing the second power transmission device to turn up and down, and a control device. The control device is configured so as to be able to select a first drive mode in which the internal combustion engine is driven and the electric motor is not driven, and a second drive mode in which the internal combustion engine is not driven and the electric motor is driven. When the first drive mode is selected, the actuator is operated so that the second power transmission device turns up.

10 Claims, 9 Drawing Sheets

FIG. 1B

FIG. 1C (a) FIRST DRIVE MODE (b) SECOND DRIVE MODE

SHIP PROPULSION SYSTEM AND SHIP

CROSS-REFERENCE

This application is a US National Stage Application under 35 U.S.C. § 371 of International Application No. PCT/W2019/019244 filed May 15, 2019, which claims foreign priority of JP2018-094203 filed May 16, 2018, the disclosures of which are hereby incorporated by reference in their entirety.

TECHNICAL FIELD

The present invention relates to a ship propulsion system powered by an internal combustion engine and an electric motor and to a ship on which the ship propulsion system is mounted.

BACKGROUND ART

At a river, lake, marina, or the like, exhaust gas and noise from an internal combustion engine mounted on a ship are likely to be seen as a problem. To attend to such a problem, it is conceivable to use an electric motor as a power source, but it is often not practical since high output cannot be obtained unless a generator or battery with a large weight and size is mounted. Furthermore, although a hybrid-type propulsion system in which an internal combustion engine and an electric motor are integrally combined has been developed in recent years, there is a problem that increase in cost is inevitable since the configuration thereof is complicating and the power source to be provided is dedicated to the system.

In Patent Literature 1, there is disclosed a ship propulsion system including an outboard internal combustion engine motor having an internal combustion engine and an outboard electric motor having an electric motor. In this system, the internal combustion engine and the electric motor are included as power sources independent from each other, so it is possible to drive both of them together or to drive either one of them independently, as desired. However, the outboard internal combustion engine motor and the outboard electric motor are connected by a connecting device, so that, even in a case where the outboard internal combustion engine motor is driven independently, the outboard electric motor is always placed in water, and therefore the propulsion resistance becomes large due to the stopped outboard electric motor, which causes a decrease in the propulsion efficiency of the ship.

In Patent Literature 2, there is disclosed a ship propulsion system in which a main propeller and two stern-side propellers that are placed line-symmetrically with respect to the rotation axis of the main propeller are included as propulsion units. The main propeller is rotated by the power transmitted from an internal combustion engine (medium speed diesel engine). The stern-side propellers are rotated by a motor to assist the propulsive force of the main propeller. Even in this system, in a case where only the main propeller is rotated and the stern-side propellers are not rotated, the stern-side propellers become a propulsion resistance, which causes a decrease in the propulsion efficiency of the ship as well.

CITATION LIST

Patent Literature

Patent Literature 1: Japanese Unexamined Patent Application Publication No. 2017-132442

Patent Literature 2: Japanese Unexamined Patent Application Publication No. 2016-153259

DISCLOSURE OF INVENTION

Problems to be Solved by the Invention

The present invention has been made in view of the above-mentioned circumstances, and an object of the present invention is to provide a ship propulsion system and a ship that are capable of preventing the propulsion efficiency from decreasing even though a propulsion unit powered by an internal combustion engine and a propulsion unit powered by an electric motor are used together.

Means for Solving the Problems

The ship propulsion system according to the present invention includes: an internal combustion engine; a first propulsion unit; a first power transmission device connected to the internal combustion engine and the first propulsion unit and configured to transmit power of the internal combustion engine to the first propulsion unit; an electric motor; a second propulsion unit; a second power transmission device connected to the electric motor and the second propulsion unit and configured to transmit power of the electric motor to the second propulsion unit, the second power transmission device being attached to a hull so as to be capable of rotating upward and downward independently from the first power transmission device; an actuator for rotating the second transmission device upward and downward; and a control device configured to be capable of selecting a first drive mode, in which the internal combustion engine is driven and the electric motor is not driven, and a second drive mode, in which the internal combustion engine is not driven and the electric motor is driven, according to an instruction of a ship operator and configured to activate the actuator so that the second power transmission device rotates upward in a case where the first drive mode is selected.

According to such a configuration, in a case where the first drive mode is selected so that only the internal combustion engine is driven, that is, in a case where the ship is propelled only by the first propulsion unit, the actuator is activated so that the second power transmission device rotates upward (tilt-up). Accordingly, the second propulsion unit, which is connected to the second power transmission device, is pulled up from the water, so as not to be a propulsion resistance. As a result, even though the propulsion unit (first propulsion unit) powered by the internal combustion engine and the propulsion unit (second propulsion unit) powered by the electric motor are used together, it is possible to prevent the propulsion efficiency from decreasing.

It is preferable to include a rotational speed detecting unit configured to detect a rotational speed of the first propulsion unit, wherein the control device is configured to be capable of selecting a third drive mode, in which the internal combustion engine and the electric motor are driven, according to an instruction of a ship operator, and, in a case where the third drive mode is selected and the rotational speed detected by the rotational speed detecting unit has exceeded a predetermined reference rotational speed, the control unit activates the actuator so that the second power transmission device rotates upward.

According to such a configuration, in a case where the third drive mode is selected and the internal combustion engine and the electric motor are driven, that is, in a case where the ship is propelled by the first propulsion unit and the second propulsion unit, the actuator is activated, based on the rotational speed of the first propulsion unit, so that the second power transmission device rotates upward (tilt-up). In a situation where a sufficient propulsive force is being delivered by the first propulsion unit, since there is a possibility that the propulsion resistance of the second propulsion unit becomes larger than the propulsive force thereof, it is possible to prevent the propulsion efficiency from decreasing by this tilt-up.

It is preferable that the control device is configured to be capable of selecting a third drive mode, in which the internal combustion engine and the electric motor are driven, according to an instruction of a ship operator, and, in a case where the third drive mode is selected and a ship speed has exceeded a predetermined reference ship speed, the control unit activates the actuator so that the second power transmission device rotates upward.

According to such a configuration, in a case where the third drive mode is selected and the internal combustion engine and the electric motor are driven, that is, in a case where the ship is propelled by the first propulsion unit and the second propulsion unit, the actuator is activated, based on the ship speed, so that the second power transmission device rotates upward (tilt-up). In a situation where the ship navigates at a high speed that is faster than the predetermined reference ship speed, a sufficient propulsive force is being delivered by the first propulsion unit, which is powered by the internal combustion engine, and it is possible to prevent the propulsion efficiency from decreasing by this tilt-up since there is a possibility that the propulsion resistance of the second propulsion unit becomes larger than the propulsive force thereof.

It is preferable to include a position information obtaining unit configured to obtain position information of the hull, wherein the control device is configured to be capable of selecting a third drive mode, in which the internal combustion engine and the electric motor are driven, according to an instruction of a ship operator, and, in a case where the third drive mode is selected and the hull has gotten out of a predetermined designated area, based on the position information obtained by the position information obtaining unit, the control unit activates the actuator so that the second power transmission device rotates upward.

According to such a configuration, in a case where the third drive mode is selected and the internal combustion engine and the electric motor are driven, that is, in a case where the ship is propelled by the first propulsion unit and the second propulsion unit, the actuator is activated, based on the position information of the hull, so that the second power transmission device rotates upward (tilt-up). Since propulsive force can be obtained by the first propulsion unit without using the second propulsion unit in a situation where the hull has gotten out of the predetermined designated area so that problems caused by noise, etc., do not occur even though the internal combustion engine is driven, it is possible to prevent the propulsion efficiency from decreasing by this tilt-up.

It is preferable include a joystick configured to be operated by a ship operator, wherein a total of three or more of the first propulsion unit and the second propulsion unit are placed in a width direction of the hull, so as to configure a propulsion unit group, and wherein, of the propulsion units configuring the propulsion unit group, the control device is configured to control a steering angle of only a left propulsion unit that is placed on a left end and a right propulsion unit that is placed on a right end according to an operation of the joystick.

The propulsive force of the ship in the left-right direction becomes larger in a case where the steering angle is controlled only for the left propulsion unit and the right propulsion unit, compared to a case in which the steering angle is controlled only for the central propulsion unit that is placed at the center. Therefore, by controlling the steering angle only for the propulsion units (that is, the left propulsion unit and the right propulsion unit) placed at both of the left and right ends of the hull according to an operation of the joystick, it is possible to efficiently generate the propulsive force in the left-right direction.

It is preferable to include a throttle lever configured to be operated by a ship operator, wherein the control device is configured to control a rotational speed of the internal combustion engine according to an operation of the throttle lever in a case where the first drive mode is selected and to control a rotational speed of the electric motor according to an operation of the throttle lever in a case where the second drive mode is selected.

According to such a configuration, operations can be performed by use of an operation tool (that is, the throttle lever) that is common in both of the case where the first drive mode, in which the power source is the internal combustion engine, is selected and the case where the second drive mode, in which the power source is the electric motor, is selected. Therefore, since it is not necessary to change the operation method in consideration of the difference of the power sources, the ship operator can easily operate the hull.

It is preferable to include a throttle lever configured to be operated by a ship operator, wherein the control device is configured to be capable of selecting a third drive mode, in which the internal combustion engine and the electric motor are driven, according to an instruction of a ship operator and is configured to control a rotational speed of the internal combustion engine according to an operation of the throttle lever within a first operation range and to control a rotational speed of the electric motor according to an operation of the throttle lever within a second operation range in a case where the third drive mode is selected, and wherein a part of the first operation region overlaps with a part of the second operation region.

According to such a configuration, the rotational speed of the internal combustion engine is controlled in a case where the throttle lever is in the first operation range (for example, a range in which the operation angle is relatively large), and the rotational speed of the electric motor is controlled in a case where the throttle lever is in the second operation range (for example, a range in which the operation angle is relatively small). Furthermore, in the range where a part of the first operation range overlaps with a part of the second operation range, the rotational speeds of both the internal combustion engine and the electric motor are controlled. Accordingly, when switching the power sources between the internal combustion engine and the electric motor, the impact generated on the ship can be reduced because both of the power sources are driven for a period of time.

It is preferable that a total of three or more of an odd number of the first propulsion unit and the second propulsion unit are placed in a width direction of the hull, so as to configure a propulsion unit group, wherein, of the propulsion units configuring the propulsion unit group, in a case where a left propulsion unit that is placed on a left end and a right propulsion unit that is placed on a right end generate propulsive force in opposite directions from each other in a front-back direction, the control device is configured to stop a central propulsion unit that is placed at a center. Accordingly, it is possible to prevent the turning radius from becoming large in a case of making a small turn (turning on the spot) of the hull.

It is preferable that a total of three or more of an odd number of the first propulsion unit and the second propulsion unit are placed in a width direction of the hull, so as to configure a propulsion unit group, wherein, of the propulsion units configuring the propulsion unit group, in a case where a left propulsion unit that is placed on a left end and a right propulsion unit that is placed on a right end generate propulsive force in the same direction as each other in a front-back direction, the control device is configured to generate the propulsive force of the smaller one of the propulsive force of the left propulsion unit and the propulsive force of the right propulsion unit to a central propulsion unit that is placed at a center. Accordingly, it is possible to prevent the central propulsion unit from generating unnecessarily large propulsive force in a case of making a turn of the hull.

The ship according to the present invention is a ship on which any one of the above-described ship propulsion systems is mounted.

DESCRIPTION OF EMBODIMENTS

An explanation is given of an example of a ship propulsion system and a ship according to the present invention.

Figure 1A:
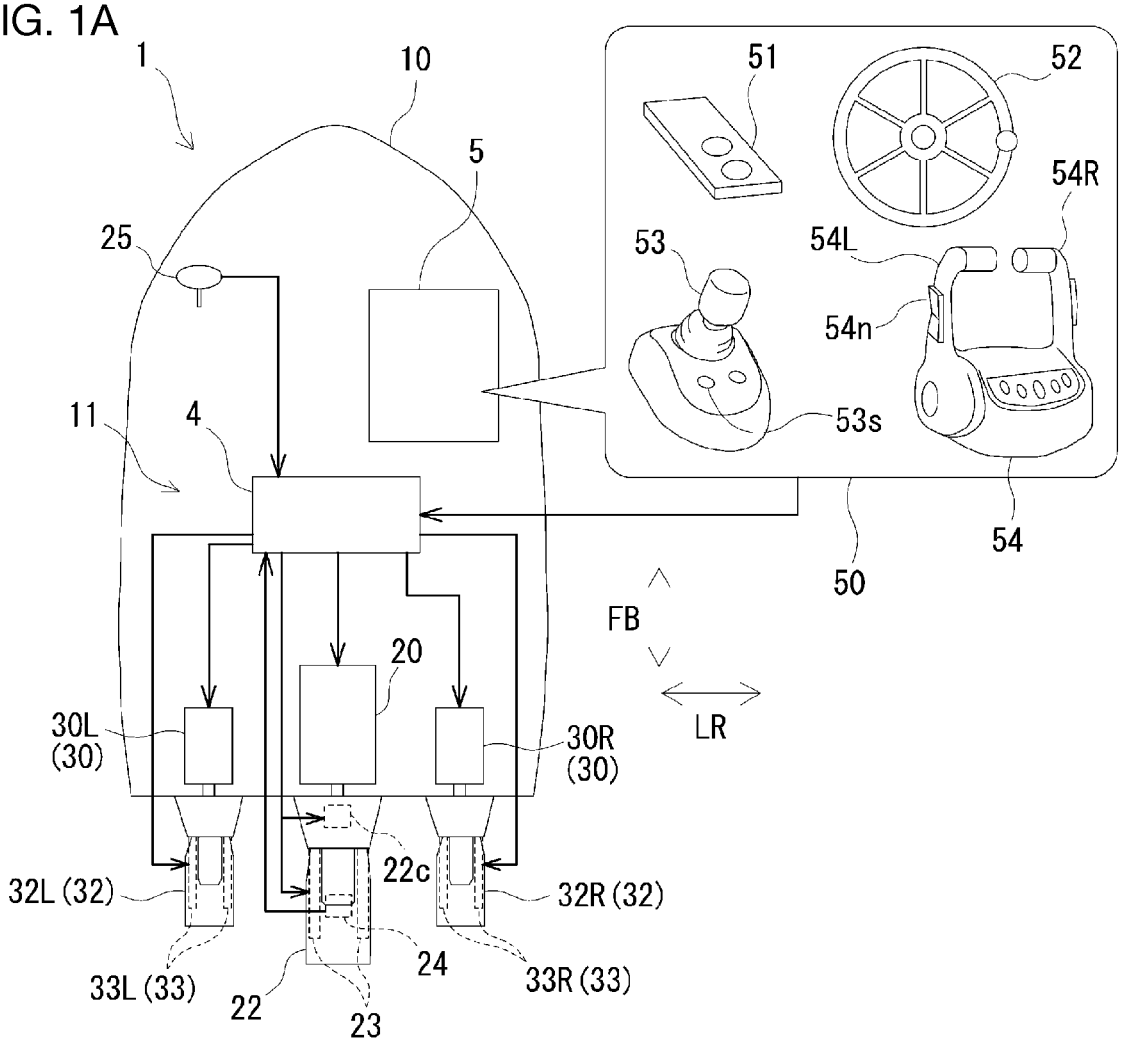
FIG. 1A is a plan view, FIG. 1B a rear view, and FIG. 1C a rear right side view schematically illustrating a ship on which an example of the ship propulsion system according to the present invention is mounted.
Figure 1B:
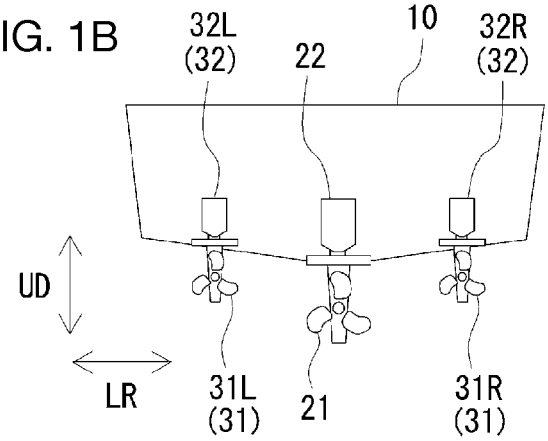
Figure 1C:
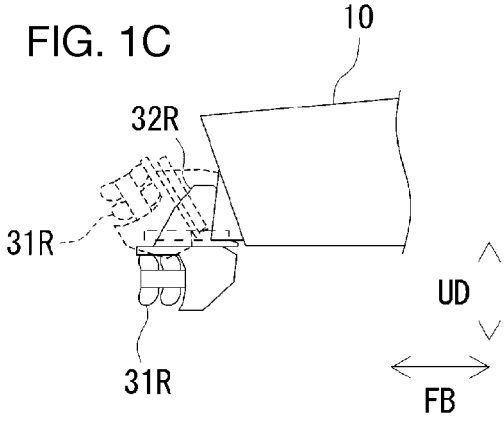

As illustrated in FIGS. 1A, 1B, and 1C, the ship 1 includes a hull 10 having a predetermined length in the front-back direction FB and a predetermined width in the left-right direction LR. The left-right direction LR corresponds to the width direction of the hull 10. The up-down direction UD is the vertical direction of the ship 1 being stationary on the water in a normal posture.

The ship 1 is a small ship such as a fishing boat, a sightseeing boat, or a cruiser. A small ship is a ship with a gross tonnage of less than 20 tons, but a ship equal to or more than 20 tons with a length of less than 24 meters and approved by the Minister of Land, Infrastructure, Transport and Tourism for the use of sports or recreation is also included as a small ship. Although an example in which the ship 1 is a pleasure boat used for leisure such as sports and recreation is described in the present embodiment, the ship 1 is not limited as such.

On the ship 1, a ship propulsion system 11 is mounted. The ship propulsion system 11 includes an internal combustion engine 20, a propeller 21 which is the first propulsion unit, a first power transmission device 22 that is connected to the internal combustion engine 20 and the propeller 21 so as to transmit power of the internal combustion engine 20 to the propeller 21, electric motors 30L and 30R (hereinafter collectively referred to as the "electric motor 30"), propellers 31L and 31R (hereinafter collectively referred to as the "propeller 31") which are the second propulsion unit, second power transmission devices 32L and 32R (hereinafter collectively referred to as the "second power transmission device 32") which are connected to the electric motor 30 and the propeller 31 so as to transmit power of the electric motor 30 to the propeller 31, actuators 33L and 33R (hereinafter collectively referred to as the "actuator 33") for rotating the second power transmission device 32 up and down, and a control device 4.

The power from the internal combustion engine 20 is transmitted to the propeller 21 while being decelerated by the first power transmission device 22 (hereinafter simply referred to as the "power transmission device 22"). The internal combustion engine 20 is a diesel engine, for example, but may also be a gasoline engine, a gas engine, or the like. The propeller 21 is powered by the internal combustion engine 20 for being rotationally driven, so as to generate propulsive force accordingly. In the present embodiment, an example in which the power transmission device 22 is an inboard/outboard motor (sterndrive) having a built-in clutch 22*c* is described. However, the power transmission device 22 may also be another drive device such as an outboard motor (outboard drive), an inboard motor (inboard drive), a POD, or a saildrive. In a case where an inboard motor is adopted, the power from the internal combustion engine 20 via a marine gearbox is transmitted to the propeller 21 through a propeller shaft.

The power from the electric motor 30 is transmitted to the propeller 31 while being decelerated by the second power transmission device 32 (hereinafter simply referred to as the "power transmission device 32"). As the electric power source of the electric motor 30, a battery (storage battery), which is not illustrated in the drawings, can be used. The internal combustion engine 20 and the electric motor 30 are mounted as power sources independent from each other, so it is possible to drive both of them together and to drive either one of them independently. The propeller 31 is powered by the electric motor 30 for being rotationally driven, so as to generate propulsive force accordingly. In the present embodiment, the power transmission device 32 is an inboard/outboard motor attached to a rear end part of the hull 10. The power transmission device 32 is not limited to an inboard/outboard motor but is preferably an inboard/outboard motor or an outboard motor from the viewpoint of rotating the power transmission device 32 up and down as described later. The power transmission device 32 is configured as a power transmission device without a clutch function from the viewpoint of preventing the cost from increasing.

Each power transmission device 32 is attached to the hull 10 so as to be capable of rotating upward and downward independently from the power transmission device 22. Therefore, it is possible to rotate the power transmission device 32 in the up-down direction without changing the position of the power transmission device 22. As the power transmission device 32 rotates up and down, the position of the propeller 31 is changed between an operating position where the propeller 31 is placed in the water and a tilt position where the propeller 31 is pulled up from the water. In FIGS. 1B and 1C, the propeller 31 in the operating position is drawn with the solid line, and the power transmission device 32 is in a state of having been rotated downward (tilted down). By rotating the power transmission devices 32 upward (tilted up) from this state, the position of the propeller 31 is changed to the tilt position as indicated by the broken line in FIG. 1C.

In the present embodiment, the power transmission device 22, which is connected to the internal combustion engine 20, is also attached to the hull 10 so as to be capable of rotating upward and downward, and the actuator 23 is included for rotating the power transmission device 22 up and down. The actuator 23 and the actuators 33 are configured with, for example, hydraulic cylinders. As with the propeller 31, the position of the propeller 21 is changed between an operating position where the propeller 21 is placed in the water and a tilt position where the propeller 21 is pulled up from the water as the power transmission device 22 rotates up and down. However, there is no such limitation that the power transmission device 22 is configured to be capable of rotating upward and downward.

Although one propeller 21 is connected to one internal combustion engine 20 and one propeller 31 is connected to one electric motor 30 in the present embodiment, the connection is not limited to such a one-to-one connection relationship. Therefore, for example, there may be such a configuration in which one propeller (first propulsion unit) is connected to multiple internal combustion engines and/or one propeller (second propulsion unit) is connected to multiple electric motors.

The driving of the internal combustion engine 20, driving of the electric motor 30, and activation of the actuator 33 are controlled by the control device 4. The control device 4 is configured to be capable of selecting the first drive mode, in which the internal combustion engine 20 is driven and the electric motor 30 is not driven, and the second drive mode, in which the internal combustion engine 20 is not driven and the electric motor 30 is driven, according to an instruction from the ship operator. In a case where the first drive mode is selected, that is, in a case where the ship 1 is propelled only by the propeller 21 powered by the internal combustion engine 20, the control device 4 activates the actuator 33 so that the power transmission device 32 rotates upward. Accordingly, the propeller 31, which is connected to the power transmission device 32, is pulled up from the water, so as not to be a propulsion resistance. As a result, even though the propeller 21 powered by the internal combustion engine 20 and the propeller 31 powered by the electric motor 30 are used together, it is possible to prevent the propulsion efficiency from decreasing.

In the ship operating unit 5 of the ship 1, there are provided operation tools 50 to be operated by the ship operator, and a display panel, driver's seat, etc., which are not illustrated in the drawings. In the present embodiment, the operation tools 50 include a switch 51, a steering wheel 52, a joystick 53, and a throttle lever 54. The throttle lever 54 includes two lever parts 54L and 54R to which a back and forth tilting operation can be performed. By operating the switch 51, the ship operator can select a desired drive mode from multiple drive modes, which at least include the first drive mode and the second drive mode, and thus the ship operator can select the power source to be driven. The selected drive mode is displayed on the display panel. Although the switch 51 is a remote control type switch, there is no such limitation, and it is also possible that the switch 51 is a lever that is installed on an operation panel or a switch that is displayed on the screen of the display panel.

Furthermore, activation of the actuator 23 can be controlled by the control device 4 as well, and, in a case where the second drive mode is selected, that is, in a case where the ship 1 is propelled only by the propeller 31 powered by the electric motor 30, the control device 4 activates the actuator 23 so that the power transmission device 22 rotates upward. Accordingly, the propeller 21, which is connected to the power transmission device 22, is pulled up from the water, so as not to be a propulsion resistance. As a result, even in a case where the second drive mode is selected, it is possible to prevent the propulsion efficiency from decreasing and to improve the propulsion performance of the ship 1.

Figure 2A:
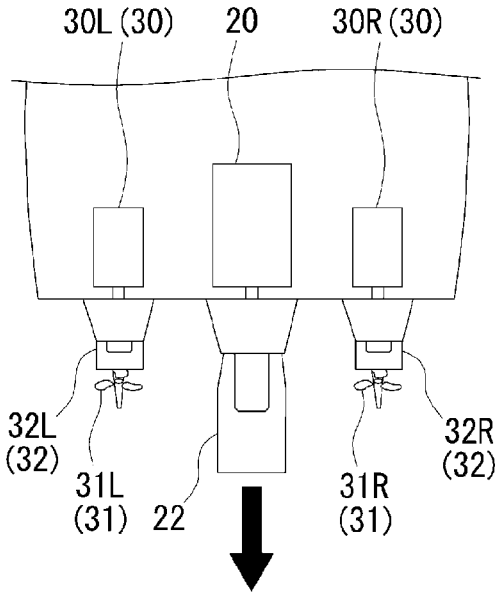
FIGS. 2A and 2B are a plan view schematically illustrating the rear end part of a hull in (a) a first drive mode and (b) a second drive mode.

In situations where problems caused by noise, etc., do not occur or where high output is required, it is conceivable to select the first drive mode, in order to drive the internal combustion engine 20 for navigation. In that case, the non-driven power transmission device 32 is tilted up as described above, so that the propeller 31 and the power transmission device 32 are not propulsion resistances, and therefore it is possible to prevent the propulsion efficiency from decreasing. In a case where the power transmission device 32 is tilted up as illustrated in FIG. 2A, the propeller 21 is in the operating position whereas the propeller 31 is in the tilt position. In the first drive mode, the power transmission device 22 is rotated left and right by the operation of the steering wheel 52, that is, the control device 4 is configured to control the steering angle of only the propeller 21 according to the operation of the steering wheel 52.

Figure 2B:
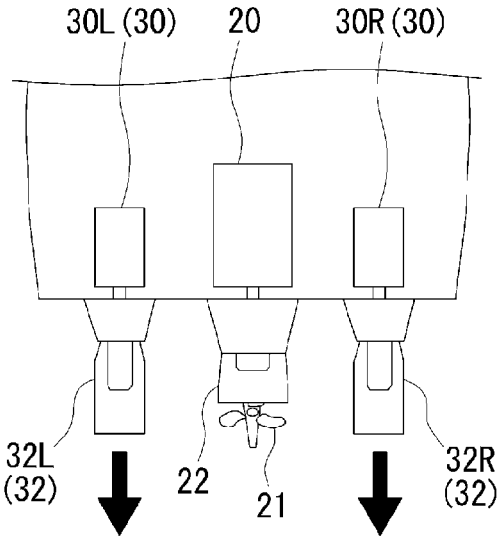

In situations of being at a river, lake, marina, or the like where exhaust gas and noise from the internal combustion engine 20 are likely to be seen as a problem, it is conceivable to select the second drive mode, so as to navigate without driving the internal combustion engine 20. In that case, the non-driven power transmission device 22 is tilted up as described above, so that the propeller 21 and the power transmission device 22 are not propulsion resistances, and therefore it is possible to prevent the propulsion efficiency from decreasing. In a case where the power transmission device 22 is tilted up as illustrated in FIG. 2B, the propeller 31 is in the operating position whereas the propeller 21 is in the tilt position. In the second drive mode, the power transmission device 32 is rotated left and right by the operation of the steering wheel 52, that is, the control device 4 is configured to control the steering angle of only the propeller 31 according to the operation of the steering wheel 52.

In the present embodiment, an example in which the ship 1 is mounted with three engines is illustrated. In the width direction (left-right direction LR) of the hull 10, three propellers 21, 31L, and 31R, which configure a propulsion unit group, are placed. The propellers 21, 31L, and 31R, which configure the propulsion unit group, are all placed behind the center of the hull 10 in the longitudinal direction (front-back direction FB). Although the three propellers 21, 31L, and 31R are aligned along the left-right direction LR, there is no such limitation and, for example, in a case where the power transmission device 22 is an inboard motor, the propeller 21 is placed at a forward position relative to the rear end part of the hull 10. It is preferable that the number of propulsion units (propellers) configuring the propulsion unit group is three or more. Therefore, although the present embodiment is configured with three engines, it is also possible that four engines or five engines are mounted.

In the present embodiment, of the propulsion units configuring the propulsion unit group, the left propulsion unit that is placed at the left end and the right propulsion unit that is placed at the right end are the propellers 31L and 31R, which are powered by the electric motors 30L and 30R, respectively. Therefore, even though the propulsive force of the propeller 31 (propellers 31L and 31R) is small, preferable turning performance can be delivered. From this point of view, in a case where four engines are mounted, it is preferable that the left propulsion unit and the right propulsion unit are configured with propulsion units powered by an electric motor and that the other two propulsion units are configured with propulsion units powered by an internal combustion engine. Furthermore, in a case where five engines are mounted, it is preferable that the left propulsion unit and the right propulsion unit as well as the pair of propulsion units adjacent thereto are configured with propulsion units powered by an electric motor and that the central one is configured with a propulsion unit powered by an internal combustion engine. However, there is no such limitation, and there may be a configuration in which propellers powered by an internal combustion engine are placed on the both left and right ends and a propeller powered by an electric motor is placed at the center.

From the viewpoint of having preferable left and right balance for delivering excellent propulsion performance, it is preferable that the maximum output of the power source (in FIG. 1A, the electric motor 30L) placed on the left side with reference to the center line in the width direction of the hull 10 is the same as the maximum output of the power source (in FIG. 1A, the electric motor 30R) placed on the right side thereof. In a case where four engines or five engines are mounted, there may be two power sources on each of the left and right sides, and, in that case, it is preferable that the total amount of the maximum outputs of the power sources placed on the left side is the same as the total amount of the maximum outputs of the power sources placed on the right side. Furthermore, it is preferable that each of the maximum outputs of the electric motors 30L and 30R is 10% or more of the maximum output of the internal combustion engine 20, so that the ship can navigate at a sufficient ship speed in the second drive mode.

As described above, in the present embodiment, the ship propulsion system 11 includes the joystick 53 which is operated by the ship operator. Additionally, a total of three or more propellers 21 and 31 (three, in the present embodiment) are placed in the width direction of the hull 10, so as to configure the propulsion unit group. The control device 4 is configured to control the steering angles of only the left propulsion unit that is placed on the left end and the right propulsion unit that is placed on the right end of the propulsion units configuring the propulsion unit group, that is, only the propellers 31L and 31R, according to operations of the joystick 53. Accordingly, it is possible to efficiently generate propulsive force in the left-right direction, which contributes the ship operation control by use of the joystick 53.

Figure 3:
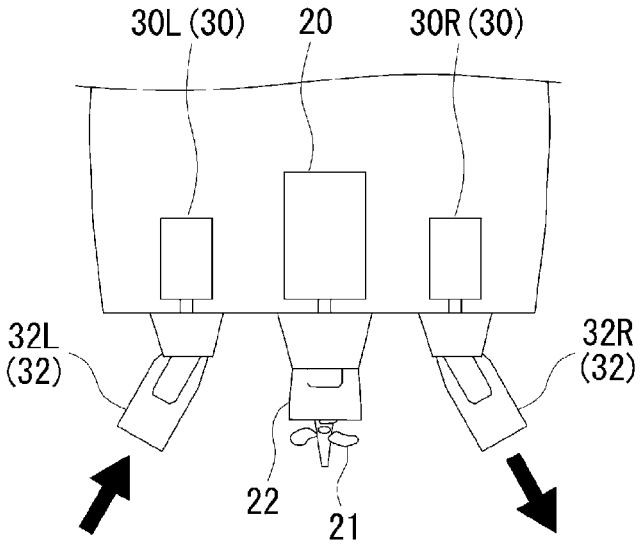
FIG. 3 is a plan view schematically illustrating the rear end part of the hull in a joystick mode.

The ship operation control by use of the joystick 53 can be performed by switching to the joystick mode. The joystick 53 is provided with a switch 53*s* for switching to the joystick mode. Since control for driving the propeller 21 which is the propulsion unit placed at the center is not necessary in the joystick mode of the present embodiment, the power transmission device 22 is tilted up as illustrated in FIG. 3, so as not to drive the internal combustion engine 20 and drive the electric motor 30 as in the second drive mode. Therefore, it is possible to quietly operate the ship in situations where the joystick mode is useful, such as when berthing and leaving a shore in a marina.

As described above, in the present embodiment, the ship propulsion system 11 includes the throttle lever 54 which is operated by the ship operator. The control device 4 is configured to control the rotational speed of the internal combustion engine 20 according to operations of the throttle lever 54 in a case where the first drive mode is selected and is configured to control the rotational speed of the electric motor 30 according to operations of the throttle lever 54 in a case where the second drive mode is selected. In this way, operation can be performed by use of an operation tool (that is, the throttle lever 54) that is common in both of the first drive mode and the second drive mode, and therefore it is not necessary for the ship operator to change the operation method and operation tool in consideration of the difference of the power sources. As a result, the sense of operating the ship barely changes even in different drive modes, so that the workability during operation of the ship is excellent.

Figure 4:
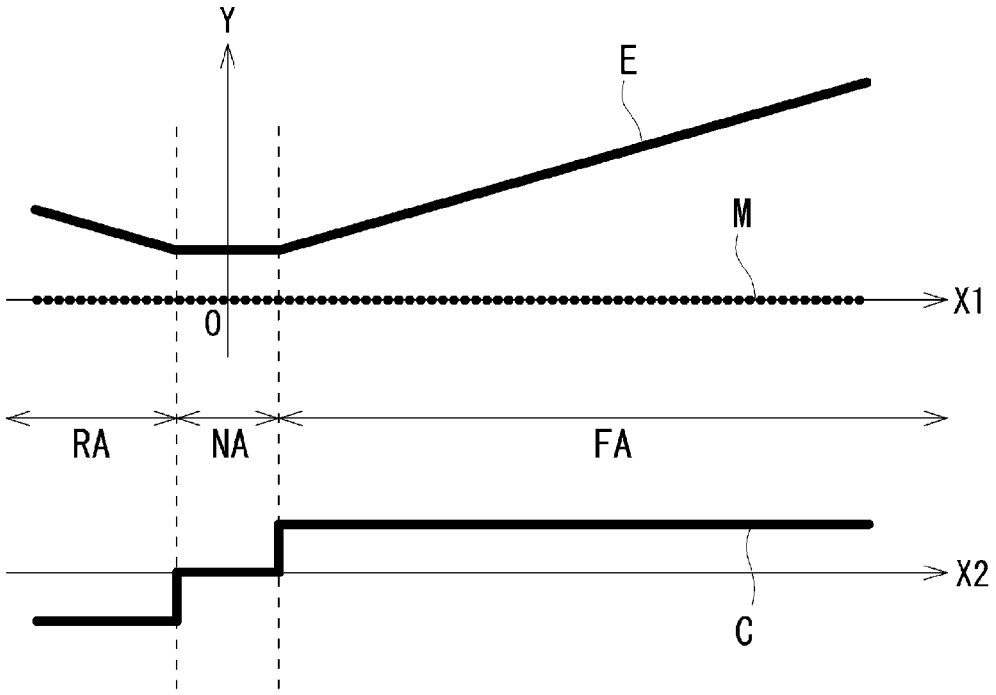
FIG. 4 is a graph illustrating an example of the rotational speeds of power sources and a clutch behavior in the first drive mode.

FIG. 4 shows the changes in the rotational speeds of the internal combustion engine 20 and the electric motor 30 according to operations of the throttle lever 54 as well as the behavior of the built-in clutch 22*c* of the power transmission device 22. Both the X1-axis and the X2-axis represent the lever position of the throttle lever 54, according to which the amount of forward tilting operation (operation angle) becomes larger as going farther rightwards from the origin O, which is the neutral position, and the amount of backward tilting operation becomes larger as going farther leftwards. The Y-axis represents the rotational speeds of the power sources, and the negative values on the lower side of the X1-axis are indicative of reverse rotation. Line E indicates the rotational speed of the internal combustion engine 20, and Line M indicates the rotational speed of the electric motor 30. Line C represents the behavior of the clutch 22*c*, according to which the clutch 22*c* is in an off-state in a case where Line C is overlapping with the X2-axis, the clutch 22*c* is in a forward movement on-state in a case where Line C is above the X2-axis, and the clutch 22*c* is in a reverse movement on-state in a case where Line C is below the X2-axis. The same applies to FIG. 5 through FIG. 7.

In the first drive mode, as illustrated in FIG. 4, according to operations of the throttle lever 54, the rotational speed of the internal combustion engine 20 is controlled and the clutch 22*c* is switched. The throttle lever 54 is an operation tool for performing acceleration/deceleration operations of the internal combustion engine 20 and performing clutch shift of the power transmission device 22 in the first drive mode. The operation range of the throttle lever 54 includes a neutral area NA, a forward movement area FA for moving the ship 1 forward, and a reverse movement area RA for moving the ship 1 backward. In a phase where the lever position is in the neutral area NA, the internal combustion engine 20 rotates at an idle speed. In a case where the lever position enters the forward movement area FA, the clutch 22*c* enters the forward movement side to get in the forward movement on-state, so that the propeller 21 rotates in the direction for moving the ship 1 forward. In a case where the lever position enters the reverse movement area RA, the clutch 22*c* enters the reverse movement side to get in the reverse movement on-state, so that the propeller 21 rotates in the direction for reversely moving the ship 1. In the present embodiment, regarding the operations of the throttle lever 54, it is possible that only one of the two lever parts 54L and 54R is effective.

Figure 5:
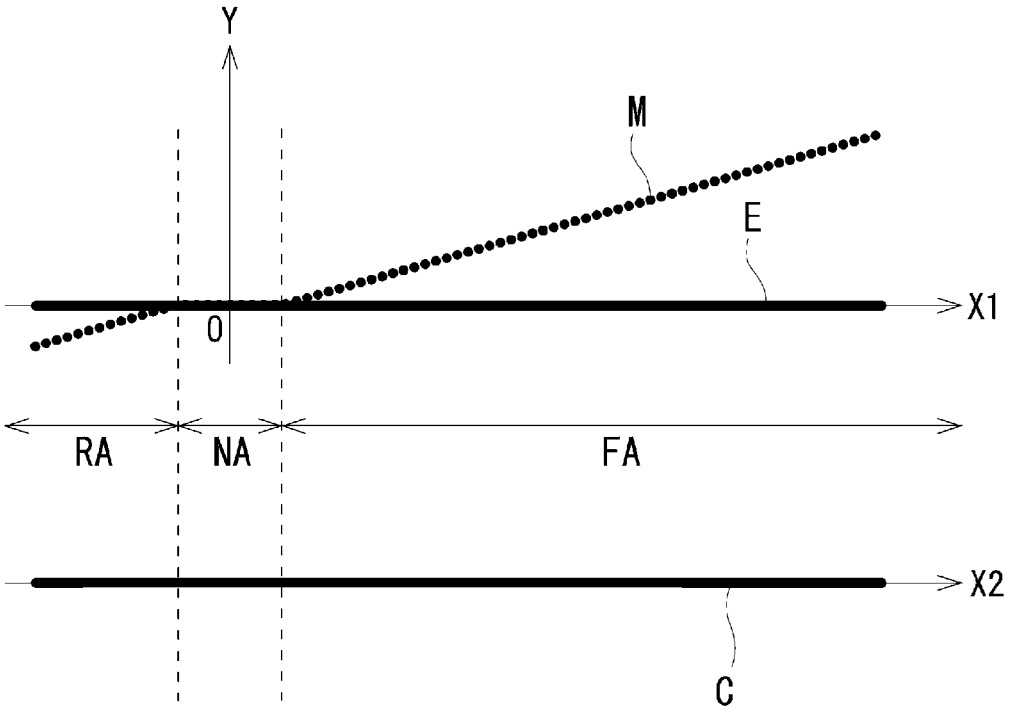
FIG. 5 is a graph illustrating an example of the rotational speeds of the power sources and a clutch behavior in the second drive mode.

In the second drive mode, as illustrated in FIG. 5, the rotational speed of the electric motor 30 is controlled according to operations of the throttle lever 54. The throttle lever 54 is an operation tool for performing acceleration/deceleration operations of the electric motor 30 in the second drive mode. In a phase where the lever position is in the neutral area NA, the electric motor 30 does not rotate. In a case where the lever position enters the forward movement area FA or the reverse movement area RA, the electric motor 30 rotates so as to rotationally drive the propeller 31. Unlike the first drive mode, the clutch 22*c* is always in an off-state. In the present embodiment, regarding the operations of the throttle lever 54, the electric motor 30L on the left side is controlled by the lever part 54L on the left side, and the electric motor 30L on the right side is controlled by the lever part 54R on the right side. It is possible that only one of the two lever parts 54L and 54R is effective in a case where there is only one propulsion unit powered by an electric motor.

In the present embodiment, the control device 4 is configured to be capable of selecting the third drive mode in which the internal combustion engine 20 and the electric motor 30 are driven according to an instruction from the ship operator. In other words, the third drive mode is a mode in which both of the internal combustion engine 20 and the electric motor 30 are used. Furthermore, in the present embodiment, the control device 4 is configured to be capable of selecting the fourth drive mode in which the internal combustion engine 20 and the electric motor 30 are driven according to an instruction from the ship operator. The fourth drive mode is different from the third drive mode in the form of driving the internal combustion engine 20 and the electric motor 30. Switching among the first through fourth drive modes can be operated by the above-described switch 51. For convenience of explanation, an explanation is given of the fourth drive mode, prior to the third drive mode.

Figure 6:
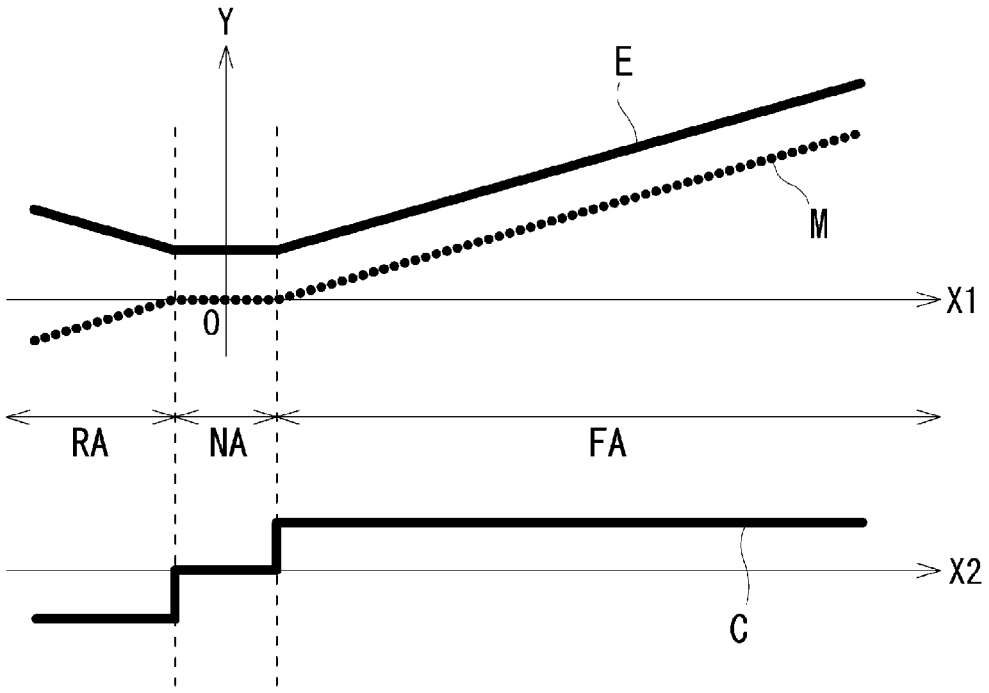
FIG. 6 is a graph illustrating an example of the rotational speeds of the power sources and a clutch behavior in the fourth drive mode.

As illustrated in FIG. 6, the fourth drive mode is a simple combination of the first drive mode and the second drive mode described above. According to the lever position of the throttle lever 54, the acceleration/deceleration operation of the internal combustion engine 20 is performed together with the acceleration/deceleration operation of the electric motor 30. It is not necessary that the rotational speed of the internal combustion engine 20 and the rotational speed of the electric motor 30 are the same. In the fourth drive mode (and the third drive mode), the operation of the throttle lever 54 is performed by use of both of the two lever parts 54L and 54R, and, in the present embodiment, it is possible that the operation is effective only in a case where the tilting operation is performed to both of the two lever parts 54L and 54R.

Figure 7:
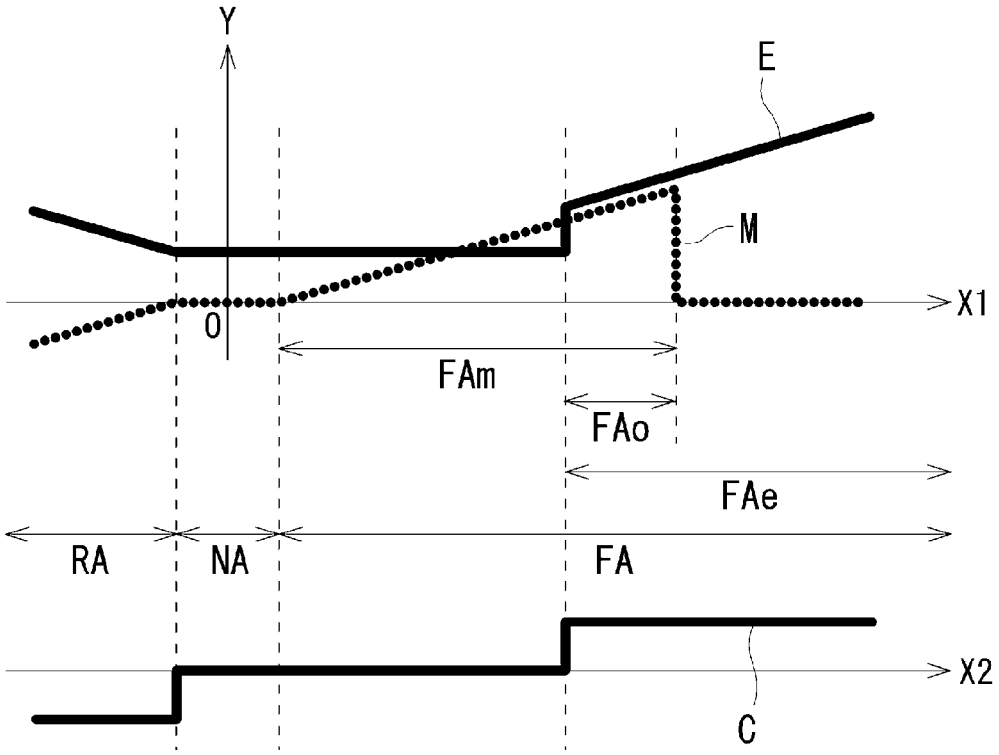
FIG. 7 is a graph illustrating an example of the rotational speeds of the power sources and a clutch behavior in the third drive mode.

In the third drive mode, as illustrated in FIG. 7, the forward movement area FA includes an internal combustion engine propulsion area FAe and an electric propulsion area FAm. The internal combustion engine propulsion area FAe is apart from the neutral area NA, and the electric propulsion area FAm is adjacent to the neutral area NA. That is, the internal combustion engine propulsion area FAe is an operation range where the operation angle of the throttle lever 54 is relatively large, and the electric propulsion area FAm is an operation range where the operation angle of the throttle lever 54 is relatively small. In a case where the lever position passes through the neutral area NA and enters the electric propulsion area FAm, the propeller 31 is rotationally driven by the electric motor 30. In a case where the lever position passes through the electric propulsion area FAm, the electric motor 30 stops. Further, in a case where the lever position enters the internal combustion engine propulsion area FAe, the clutch 22*c* gets in the forward movement on-state, so that the propeller 21 is rotationally driven by the internal combustion engine 20. Even though the lever position is in the forward movement area FA, if the lever position does not enter the internal combustion engine propulsion area FAe, the clutch 22*c* remains in the off-state, so that the acceleration/deceleration operation of the internal combustion engine 20 is not performed.

In this way, the control device 4 is configured to control the rotational speed of the internal combustion engine 20 according to operations of the throttle lever 54 in the internal combustion engine propulsion area FAe (corresponding to the first operation range) and control the rotational speed of the electric motor 30 according to operations of the throttle lever 54 in the electric propulsion area FAm (corresponding to the second operation range) in a case where the third drive mode is selected. Since the internal combustion engine 20 is not driven in a situation where the ship navigates at a relatively low speed, the third drive mode is appropriate for navigation at a marina or the like where there is a concern about problems caused by exhaust gas or noise. In addition, in a situation where the ship navigates at a relatively high speed, that is, in a situation where high output is required, the internal combustion engine 20 can be driven for navigation. In this way, by using the electric motor 30 as the power source in a low speed area and using the internal combustion engine 20 as the power source in a high speed area, each characteristic can be effectively utilized.

In the present embodiment, a part of the internal combustion engine propulsion area FAe overlaps with a part of the electric propulsion area FAm. As illustrated in FIG. 7, the forward movement area FA includes an overlap area FAo in which the internal combustion engine propulsion area FAe and the electric propulsion area FAm overlap. In the overlap area FAo, the rotational speeds of both of the internal combustion engine 20 and the electric motor 30 are controlled according to operations of the throttle lever 54. In a case where the lever position passes through the overlap area FAo, the electric motor 30 stops and only the internal combustion engine 20 is driven. By setting the overlap area FAo as such, it is possible to reduce an impact generated on the ship 1 when the power source is switched from the electric motor 30 to the internal combustion engine 20.

In the third drive mode, since the electric motor 30 stops in a case where the lever position passes through the electric propulsion area FAm (and the overlap area FAo), it is desired to tilt up the power transmission device 32 in that phase, so as to prevent the propulsion efficiency from decreasing. Furthermore, since the electric motor 30 rotates when the lever position is returned to the electric propulsion area FAm (and the overlap area FAo), it is necessary to tilt down the power transmission device 32 by then. By performing this tilting behavior of the power transmission device 32 automatically, the convenience can be further improved. Specifically, the first through third forms explained below are conceivable. These forms can be adopted in combination without any particular restrictions, and, for example, it is possible that the first form is adopted for the tilt-up control and the second form is adopted for the tilt-down control.

In the first form, the tilting behavior of the power transmission device 32 is controlled based on the rotational speed of a propulsion unit. In this case, the ship propulsion system 11 includes a rotational speed detecting unit 24 that detects the rotational speed of the propeller 21 as illustrated in FIG. 1B, so that a detection signal thereof is sent to the control device 4. The control device 4 activates the actuator 33 so that the power transmission device 32 rotates upward in a case where the third drive mode is selected and the rotational speed detected by the rotational speed detecting unit 24 has exceeded a reference rotational speed. In a situation where a sufficient propulsive force is being delivered by the propeller 21, since there is a possibility that the propulsion resistance of the propeller 31 becomes larger than the propulsive force thereof, it is possible to prevent the propulsion efficiency from decreasing by tilting up the power transmission device 32.

Although the rotational speed detecting unit 24 directly detects the rotational speed of the propeller 21 in the present embodiment, there is no such limitation, and, for example, it is also possible to detect the rotational speed of the internal combustion engine 20 or a clutch signal, so as to calculate the rotational speed of the propeller 21, based on the rotational speed of the internal combustion engine 20 or the clutch signal. The reference rotational speed is predetermined as the rotational speed of the propeller 21 to be detected in a phase where the electric motor 30 stops rotating, that is, in a phase where the lever position passes through the electric propulsion area FAm (and the overlap area FAo). The reference rotational speed can be set in the range of 30 to 60% of the maximum rotational speed (the max speed described in the specifications) of the propeller 21, for example.

It is also possible that the control device 4 activates the actuator 33 so that the power transmission device 32 rotates downward in a case where the rotational speed detected by the rotational speed detecting unit 24 has fallen below the predetermined reference rotational speed. It is also possible that the reference rotational speed for this tilt-down is different from the reference rotational speed for the above-described tilt-up. That is, multiple reference rotational speeds for tilt-up and tilt-down can be set. Furthermore, instead of or in addition to the above, it is conceivable to detect the rotational speed of the propeller 31, which is powered by the electric motor 30, so as to control the tilting behavior of the power transmission device 32, based on the detected rotational speed.

In the second form, the tilting behavior of the power transmission device 32 is controlled based on the ship speed. In this case, the control device 4 activates the actuator 33 so that the power transmission device 32 rotates upward in a case where the third drive mode is selected and the ship speed has exceeded a predetermined reference ship speed. In a situation where the ship navigates at a high speed that is faster than the predetermined reference ship speed, since a sufficient propulsive force is being delivered by the propeller 21 powered by the internal combustion engine 20 and there is a possibility that the propulsion resistance of the propeller 31 becomes larger than the propulsive force thereof, it is possible to prevent the propulsion efficiency from decreasing by the tilt-up. The reference ship speed can be set in the range of 2 kt to ⅓ of the maximum ship speed, for example. Furthermore, it is also possible that the control device 4 tilts down the power transmission device 32 in a case where the ship speed has fallen below the predetermined reference ship speed and that multiple reference ship speeds for tilt-up and for tilt-down are set.

In the third form, the tilting behavior of the power transmission device 32 is controlled based on the position of the hull. In this case, the ship propulsion system 11 includes a position information obtaining unit 25 that obtains position information of the hull 10 as illustrated in FIGS. 1A, 1B, and 1C, so that the obtained position information is sent to the control device 4. The control device 4 activates the actuator 33 so that the power transmission device 32 rotates upward in a case where the third drive mode is selected and the hull 10 has gotten out of a predetermined designated area, based on the position information obtained by the position information obtaining unit 25. In a situation where the hull 10 has gotten out of the predetermined designated area so that problems caused by noise, etc., do not occur even though the internal combustion engine 20 is driven, since propulsive force can be obtained by the propeller 21 without the propeller 31, it is possible to prevent the propulsion efficiency from decreasing by the tilt-up.

The position information obtaining unit 25 receives, for example, a signal from a positioning satellite of a satellite positioning system (GNSS), such as GPS, and sends the signal to the control device 4 as position information. The control device 4 determines whether or not the hull 10 has gotten out of the designated area, based on the position information (for example, information of the latitude and longitude) of the hull 10. The designated area is predetermined as an area where navigation at a low speed is expected or an area where quiet navigation is required, such as a port area. The designated area can be set by the user, but it is also possible to obtain the designated area from map information (by downloading through an app). Furthermore, it is also possible that the control device 4 tilts down the power transmission device 32 in a case where the hull 10 has returned to the designated area, and it is also possible that multiple designated areas for tilt-up and for tilt-down are set.

Figure 8:
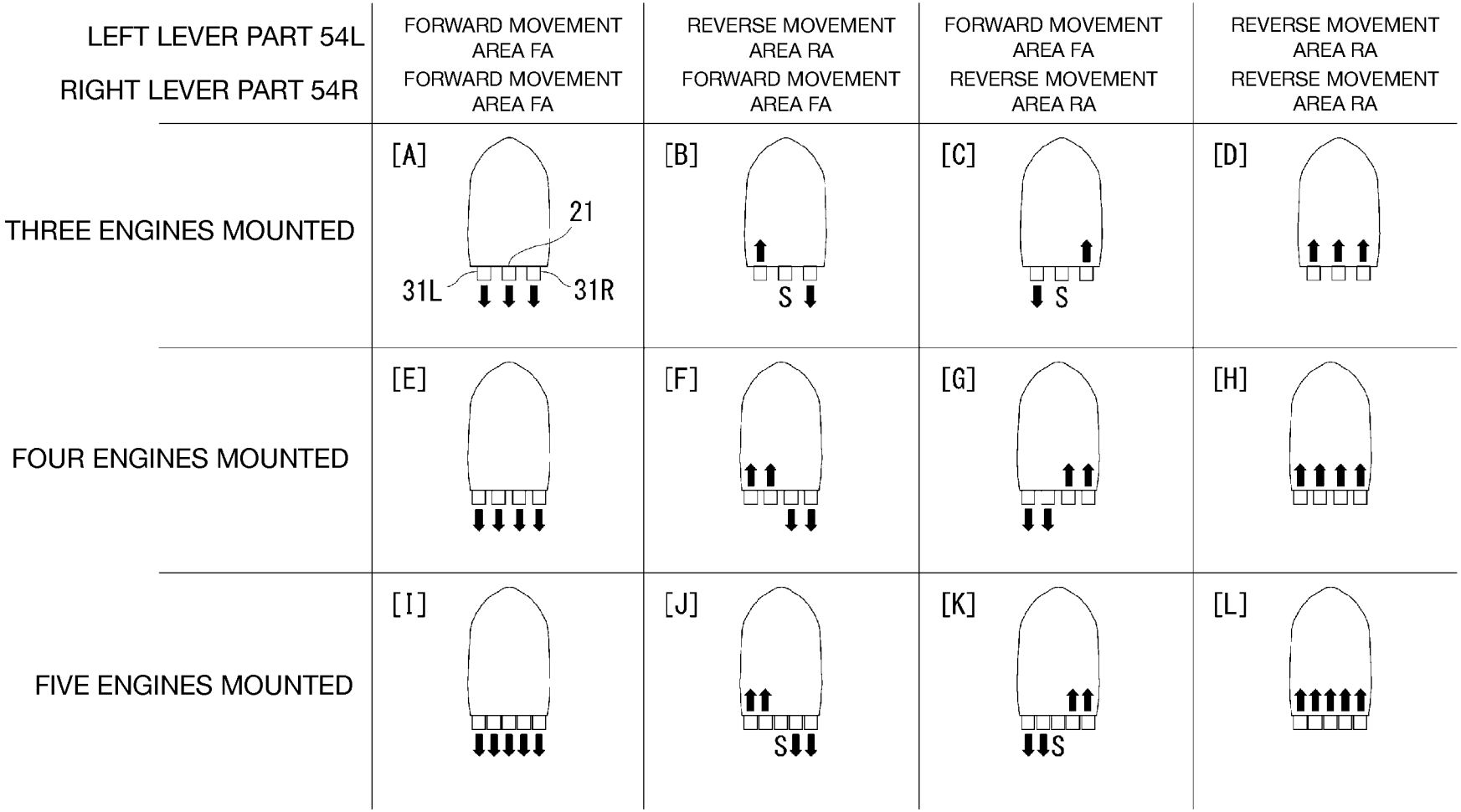
FIG. 8 is a diagram illustrating the relationship between operation directions of a throttle lever and speed command control.

FIG. 8 shows the relationship between tilting directions (operation directions) of the left and right lever parts 54L and 54R and speed command control in a case where the operations of the throttle lever 54 are performed by use of both of the two lever parts 54L and 54R as in the above-described third and fourth drive modes. The arrows in the drawing represent the propulsive force generated by propulsion units (propellers), and a downward arrow indicates forward movement and an upward arrow indicates reverse movement. "S" in the drawing means that the propulsion unit is stopped. Of the propulsion units configuring the propulsion unit groups, the propulsion units positioned on the left side are controlled according to operations of the lever part 54L on the left side, and the propulsion units positioned on the right side are controlled according to operations of the lever part 54R on the right side. With such a configuration, the sense of operating the ship is the same, regardless of the number of propulsion units configuring a propulsion unit group.

As illustrated in FIG. 8, in the cases where three engines are mounted and five engines are mounted, first propulsion units and second propulsion units are placed in the width direction of the hull 10 so that a propulsion unit group is configured with three or more of an odd number of propulsion units in total. The control device 4 is configured to stop the central propulsion unit (propeller 21) that is placed at the center in a case where, of the propulsion units configuring the propulsion unit group thereof, the left propulsion unit (propeller 310 that is placed on the left end and the right propulsion unit (propeller 31R) that is placed on the right end generate propulsive force in opposite directions from each other in the front-back direction, that is, in a case where the lever part 54L and the lever part 54R are tilted in opposite directions from each other (see [B], [C], [J], [K] in FIG. 8). Accordingly, it is possible to prevent the turning radius from becoming unnecessarily large in a case of making a small turn (turning on the spot) of the hull 10. In addition, in order to avoid operations from becoming complicating, it is preferable that the control device 4 controls the central propulsion unit to be stopped so that the steering angle thereof is maintained in the straight direction.

Figure 9:
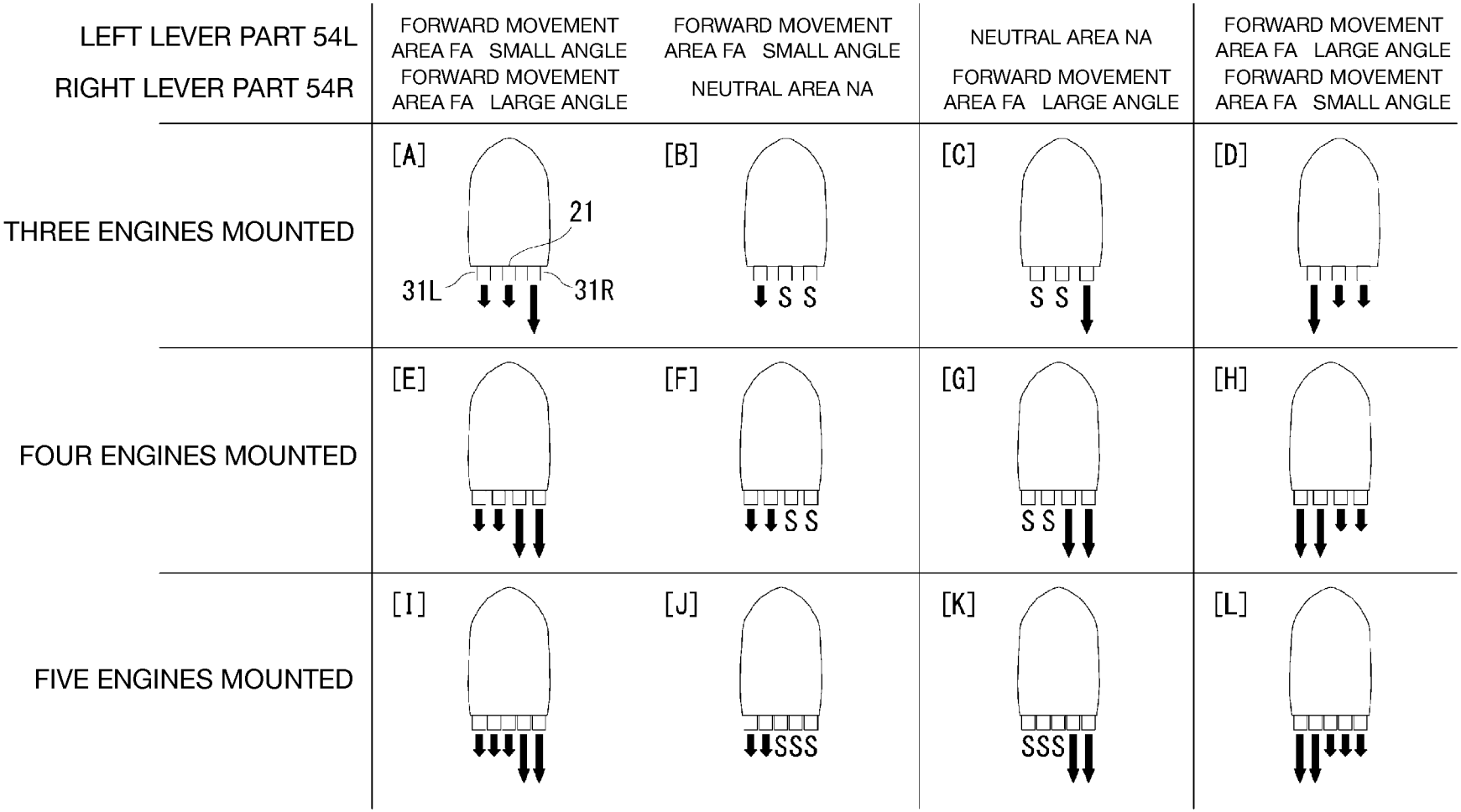
FIG. 9 is a diagram illustrating the relationship between operation angles of a throttle lever and speed command control.

FIG. 9 shows the relationship between the amounts of tilting operation (operation angles) of the left and right lever parts 54L and 54R and speed command control in a case where the operations of the throttle lever 54 are performed by use of both of the two lever parts 54L and 54R as in the above-described third and fourth drive modes. The meaning of the arrows in the drawing is the same as in FIG. 8, and the lengths of the arrows represent the magnitude of propulsive force. In addition, "SMALL ANGLE" represents a relatively small operation angle (for example, 30% of the maximum operation angle), and "LARGE ANGLE" indicates a relatively large operation angle (for example, 80% of the maximum operation angle). In a case where the lever position is in the reverse movement area RA, the same control as in FIG. 9 is performed, except that the propulsive force is reversed.

As illustrated in FIG. 9, in the cases where three engines are mounted and five engines are mounted, first propulsion units and second propulsion units are placed in the width direction of the hull 10 so that a propulsion unit group is configured with three or more of an odd number of propulsion units in total. In a case where, of the propulsion units configuring the propulsion unit group thereof, the left propulsion unit (propeller 310 that is placed on the left end and the right propulsion unit (propeller 31R) that is placed on the right end generate propulsive force in the same direction as each other in the front-back direction, the control device 4 is configured to generate the propulsive force of the smaller one of the propulsive force of the left propulsion unit and the propulsive force of the right propulsion unit to the central propulsion unit (propeller 21) that is placed at the center (see [A], [D], [I], [L] in FIG. 9). Therefore, in a case where the lever part 54L and the lever part 54R are tilted in the same direction as each other and the operation angles thereof are different, the central propulsion unit is driven with a speed command value of the smaller one of the operation angles. Accordingly, it is possible to prevent the central propulsion unit from generating unnecessarily large propulsive force in a case of making a turn of the hull 10.

Furthermore, the control device 4 is configured not to generate propulsive force to the central propulsion unit (propeller 21) that is placed at the center in a case where either one of the left propulsion unit (propeller 310 and the right propulsion unit (propeller 31R) does not generate propulsive force, that is, in a case where the lever position of either one of the lever part 54L and the lever part 54R is in the neutral area NA ([B], [C], [J], [K] in FIG. 9). In this case, it is possible to prevent the central propulsion unit from generating unnecessary propulsive force in a case of making a turn of the hull 10 as well.

Regarding the modes in which both of the internal combustion engine 20 and the electric motor 30 are driven, although the example in which acceleration/deceleration operations of both of the internal combustion engine 20 and the electric motor 30 are performed according to the lever position of the throttle lever 54 is illustrated in the above-described embodiment, it is also conceivable that acceleration/deceleration operations of the electric motor 30 are performed by use of the notch 54*n* (see FIG. IA) instead of the lever parts 54L and 54R of the throttle lever 54. The notch 54*n* is a seesaw type switch whose tilt angle changes according to the pushed amount, and, for example, the notch 54*n* is mounted on side surfaces of the lever parts 54L and 54R. It is also possible that the notch 54*n* is configured with a button switch of which the pushed amount can be adjusted.

In a case of using the above-described notch 54*n*, the acceleration/deceleration operations of the internal combustion engine 20 are performed by tilting the lever part 54L and/or the lever part 54R, and, in addition, the acceleration/deceleration operations of the electric motor 30 are performed by tilting the notch 54*n*. The timing to operate the notch 54*n* is arbitrary for the ship operator, and, in a case where the ship operator wants to accelerate the ship 1, it is possible that the electric motor 30 is supplementarily driven as a boost function or the like. In addition, in order to perform intuitive operations and fine speed control, it is preferable that the control device 4 makes operations of the notch 54*n* ineffective (that is, the electric motor 30 is not driven) in a phase where the lever position is in the neutral area NA, that the control device 4 rotates the electric motor 30 in the forward movement direction according to operations of the notch 54*n* in a phase where the lever position is in the forward movement area FA, and that the control device 4 rotates the electric motor 30 in the reverse movement direction according to operations of the notch 54*n* in a phase where the lever position is in the reverse movement area RA.

The present invention is not limited to the above-described embodiment at all, and various improvements and modifications can be made in a range without departing from the gist of the present invention.

DESCRIPTION OF REFERENCE NUMERALS

1 ship
4 control device
10 hull
11 ship propulsion system
20 internal combustion engine
21 propeller (first propulsion unit)
22 first power transmission device
22 clutch
23 actuator
24 rotational speed detecting unit
25 position information obtaining unit
30 electric motor
31 propeller (second propulsion unit)
32 second power transmission device
33 actuator
50 operation tool
51 switch
52 steering wheel
53 joystick
54 throttle lever
54L left lever part
54R right lever part

The invention claimed is:

1. A ship propulsion system comprising:
an internal combustion engine;
a first propulsion unit;
a first power transmission device connected to the internal combustion engine and the first propulsion unit and configured to transmit power of the internal combustion engine to the first propulsion unit;

an electric motor;

a second propulsion unit;

a second power transmission device connected to the electric motor and the second propulsion unit and configured to transmit power of the electric motor to the second propulsion unit, the second power transmission device being attached to a hull so as to be capable of rotating upward and downward independently from the first power transmission device;

an actuator for rotating the second transmission device upward and downward; and a control device configured to be capable of selecting a first drive mode, in which the internal combustion engine is driven and the electric motor is not driven, and a second drive mode, in which the internal combustion engine is not driven and the electric motor is driven, according to an instruction of a ship operator and configured to activate the actuator so that the second power transmission device rotates upward in a case where the first drive mode is selected.

2. The ship propulsion system according to claim 1 comprising a rotational speed detecting unit configured to detect a rotational speed of the first propulsion unit, wherein the control device is configured to be capable of selecting a third drive mode, in which the internal combustion engine and the electric motor are driven, according to an instruction of a ship operator, and, in a case where the third drive mode is selected and the rotational speed detected by the rotational speed detecting unit has exceeded a predetermined reference rotational speed, the control unit activates the actuator so that the second power transmission device rotates upward.

3. The ship propulsion system according to claim 1, wherein the control device is configured to be capable of selecting a third drive mode, in which the internal combustion engine and the electric motor are driven, according to an instruction of a ship operator, and, in a case where the third drive mode is selected and a ship speed has exceeded a predetermined reference ship speed, the control unit activates the actuator so that the second power transmission device rotates upward.

4. The ship propulsion system according to claim 1 comprising a position information obtaining unit configured to obtain position information of the hull, wherein the control device is configured to be capable of selecting a third drive mode, in which the internal combustion engine and the electric motor are driven, according to an instruction of a ship operator, and, in a case where the third drive mode is selected and the hull has gotten out of a predetermined designated area, based on the position information obtained by the position information obtaining unit, the control unit activates the actuator so that the second power transmission device rotates upward.

5. The ship propulsion system according to claim 1, comprising a joystick configured to be operated by a ship operator, wherein a total of three or more of the first propulsion unit and the second propulsion unit are placed in a width direction of the hull, so as to configure a propulsion unit group, and wherein, of the propulsion units configuring the propulsion unit group, the control device is configured to control a steering angle of only a left propulsion unit that is placed on a left end and a right propulsion unit that is placed on a right end according to an operation of the joystick.

6. The ship propulsion system according to claim 1, comprising a throttle lever configured to be operated by a ship operator, wherein the control device is configured to control a rotational speed of the internal combustion engine according to an operation of the throttle lever in a case where the first drive mode is selected and to control a rotational speed of the electric motor according to an operation of the throttle lever in a case where the second drive mode is selected.

7. The ship propulsion system according to claim 1, comprising a throttle lever configured to be operated by a ship operator, wherein the control device is configured to be capable of selecting a third drive mode, in which the internal combustion engine and the electric motor are driven, according to an instruction of a ship operator and is configured to control a rotational speed of the internal combustion engine according to an operation of the throttle lever within a first operation range and to control a rotational speed of the electric motor according to an operation of the throttle lever within a second operation range in a case where the third drive mode is selected, and wherein a part of the first operation region overlaps with a part of the second operation region.

8. The ship propulsion system according to claim 1, wherein a total of three or more of an odd number of the first propulsion unit and the second propulsion unit are placed in a width direction of the hull, so as to configure a propulsion unit group, and wherein, of the propulsion units configuring the propulsion unit group, in a case where a left propulsion unit that is placed on a left end and a right propulsion unit that is placed on a right end generate propulsive force in opposite directions from each other in a front-back direction, the control device is configured to stop a central propulsion unit that is placed at a center.

9. The ship propulsion system according to claim 1, wherein a total of three or more of an odd number of the first propulsion unit and the second propulsion unit are placed in a width direction of the hull, so as to configure a propulsion unit group, and wherein, of the propulsion units configuring the propulsion unit group, in a case where a left propulsion unit that is placed on a left end and a right propulsion unit that is placed on a right end generate propulsive force in the same direction as each other in a front-back direction, the control device is configured to generate the propulsive force of the smaller one of the propulsive force of the left propulsion unit and the propulsive force of the right propulsion unit to a central propulsion unit that is placed at a center.

10. A ship on which the ship propulsion system according to claim 1 is mounted.

* * * * *